US010245504B2

(12) United States Patent
Yang

(10) Patent No.: US 10,245,504 B2
(45) Date of Patent: Apr. 2, 2019

(54) MULTI-AXIS ROTATIONAL PUZZLE CUBE

(71) Applicant: Ju-Hsun Yang, Taichung (TW)

(72) Inventor: Ju-Hsun Yang, Taichung (TW)

( * ) Notice: Subject to any disclaimer, the term of this patent is extended or adjusted under 35 U.S.C. 154(b) by 0 days.

(21) Appl. No.: 15/952,441

(22) Filed: Apr. 13, 2018

(65) Prior Publication Data

US 2018/0311567 A1 Nov. 1, 2018

(30) Foreign Application Priority Data

Apr. 28, 2017 (TW) ..... 106114345 A

(51) Int. Cl.
*A63F 9/08* (2006.01)

(52) U.S. Cl.
CPC ..... *A63F 9/0842* (2013.01); *A63F 9/083* (2013.01); *A63F 9/0838* (2013.01); *A63F 9/0857* (2013.01); *A63F 2009/0846* (2013.01)

(58) Field of Classification Search
CPC ..... A63F 9/08; A63F 9/0826; A63F 9/083; A63F 9/0838; A63F 9/0842; A63F 2009/0846; A63F 9/0857; A63F 9/0861
See application file for complete search history.

(56) References Cited

U.S. PATENT DOCUMENTS 4,553,754 A * 11/1985 Wiggs ..... A63F 9/0857 273/153 S
5,215,305 A * 6/1993 Hsun ..... A63F 9/08 273/153 S
5,333,869 A * 8/1994 Hsun ..... A63F 9/0842 273/153 S
5,575,476 A * 11/1996 Yang ..... A63F 9/0842 273/153 S
5,816,571 A * 10/1998 Chen ..... A63F 9/0857 273/153 S
5,823,530 A * 10/1998 Yang ..... A63F 9/0865 273/153 S
5,836,584 A * 11/1998 Chen ..... A63F 9/0857 273/153 S
9,409,080 B1 * 8/2016 Yang ..... A63F 9/0826
2008/0230988 A1 * 9/2008 Paquette ..... A63F 9/0838 273/153 R

FOREIGN PATENT DOCUMENTS

EP 0512928 A1 * 11/1992 ..... A63F 9/083
EP 2441502 A1 * 4/2012
EP 3100776 A1 * 12/2016 ..... A63F 9/083

* cited by examiner

*Primary Examiner* — Steven B Wong
(74) *Attorney, Agent, or Firm* — Rabin & Berdo, P.C.

(57) ABSTRACT

A multi-axis rotational puzzle cube has a core unit and multiple first operating assemblies and multiple second operating assemblies rotatably assembled to the core unit. Each one of the multiple first operating assemblies has a first operating unit connected to the core unit, a snap rivet connected to the first operating unit inside the core unit, a blocking tube mounted around and stuck with the snap rivet, and a compression spring mounted around the snap rivet and abutting against the core unit and the blocking tube simultaneously. Each one of the multiple second operating assemblies has a second operating unit connected to the core unit, a snap rivet connected to the second operating unit inside the core unit, a blocking tube mounted around and stuck with the snap rivet, and a compression spring mounted around the snap rivet and abutting against the core unit and the blocking tube simultaneously.

12 Claims, 10 Drawing Sheets

MULTI-AXIS ROTATIONAL PUZZLE CUBE

BACKGROUND OF THE INVENTION

1. Field of the Invention

The present invention relates to a puzzle device, and more particularly to a multi-axis rotational puzzle cube that can be operated smoothly.

2. Description of Related Art

A magic cube, or Rubik's cube, is a traditional puzzle toy invented by a Hungarian professor of architecture, Emo Rubik, in 1974. However, after worldwide distribution over half a century, solutions to the magic cube are discovered by players. Some players even invented rules and quick solutions to solve the magic cube. In order to challenge the players of puzzle toys and regain their enthusiasm for the puzzle toys, a conventional puzzle device in a ball shape was invented. The conventional puzzle device has many components, is much more sophisticated than the magic cube, and is difficult to be solved. Nevertheless, the conventional puzzle device is delicate and the components of the conventional puzzle device easily interfere with one another. Therefore, the conventional puzzle device has a drawback that it is hard to be operated smoothly.

To overcome the shortcomings of the conventional puzzle device, the present invention provides a multi-axis rotational puzzle cube to mitigate or obviate the aforementioned problems.

SUMMARY OF THE INVENTION

The main objective of the present invention is to provide a multi-axis rotational puzzle cube that is sophisticated and may be operated smoothly.

The multi-axis rotational puzzle cube comprises a core unit and multiple first operating assemblies, and multiple second operating assemblies rotatably assembled to the core unit. Each one of the multiple first operating assemblies has a first operating unit connected to the core unit, a snap rivet connected to the first operating unit inside the core unit, a blocking tube mounted around and stuck with the snap rivet, and a compression spring mounted around the snap rivet and abutting against the core unit and the blocking tube simultaneously. Each one of the multiple second operating assemblies has a second operating unit connected to the core unit, a snap rivet connected to the first operating unit inside the core unit, a blocking tube mounted around and stuck with the snap rivet, and a compression spring mounted around the snap rivet and abutting against the core unit and the blocking tube simultaneously.

Other objects, advantages, and novel features of the invention will become more apparent from the following detailed description when taken in conjunction with the accompanying drawings.

DETAILED DESCRIPTION OF PREFERRED EMBODIMENTS

Figure 1:
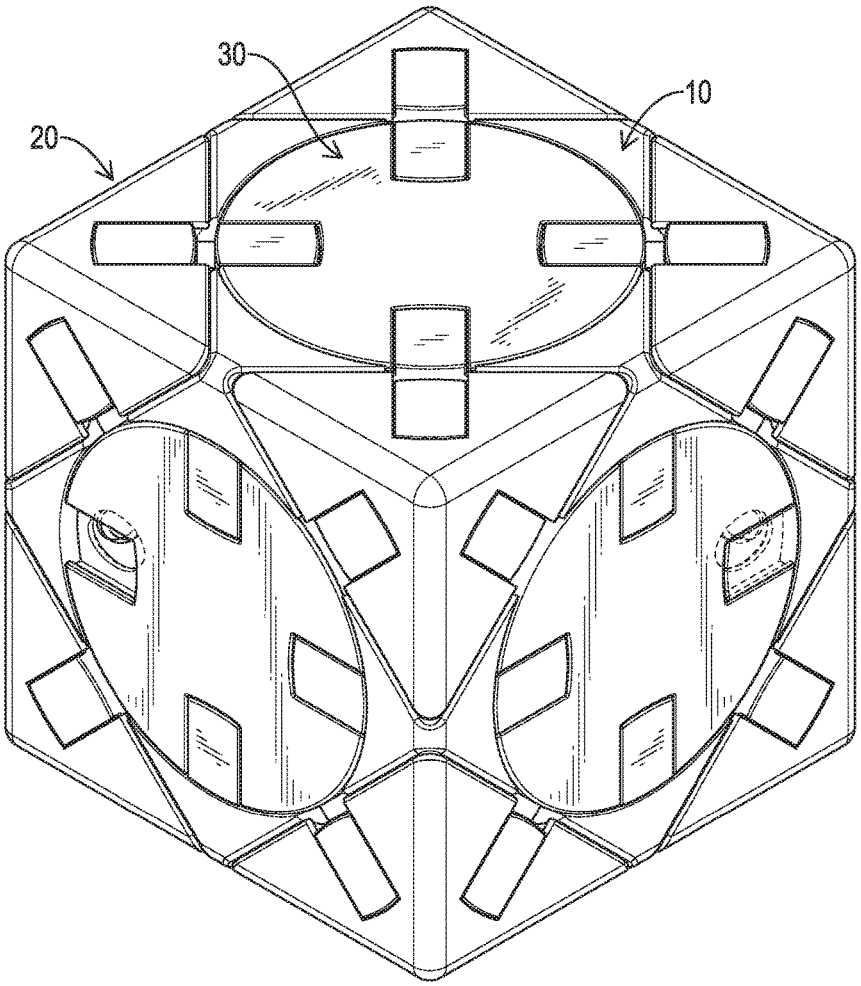
FIG. 1 is a perspective view of a first embodiment of a multi-axis rotational puzzle cube in accordance with the present invention.

With reference to FIG. 1, a first embodiment of a multi-axis rotational puzzle cube in accordance with the present invention has a core unit 10, multiple first operating assemblies 20, and multiple second operating assemblies 30. The multiple first operating assemblies 20 and the multiple second operating assemblies 30 are assembled to the core unit 10.

Figure 2:
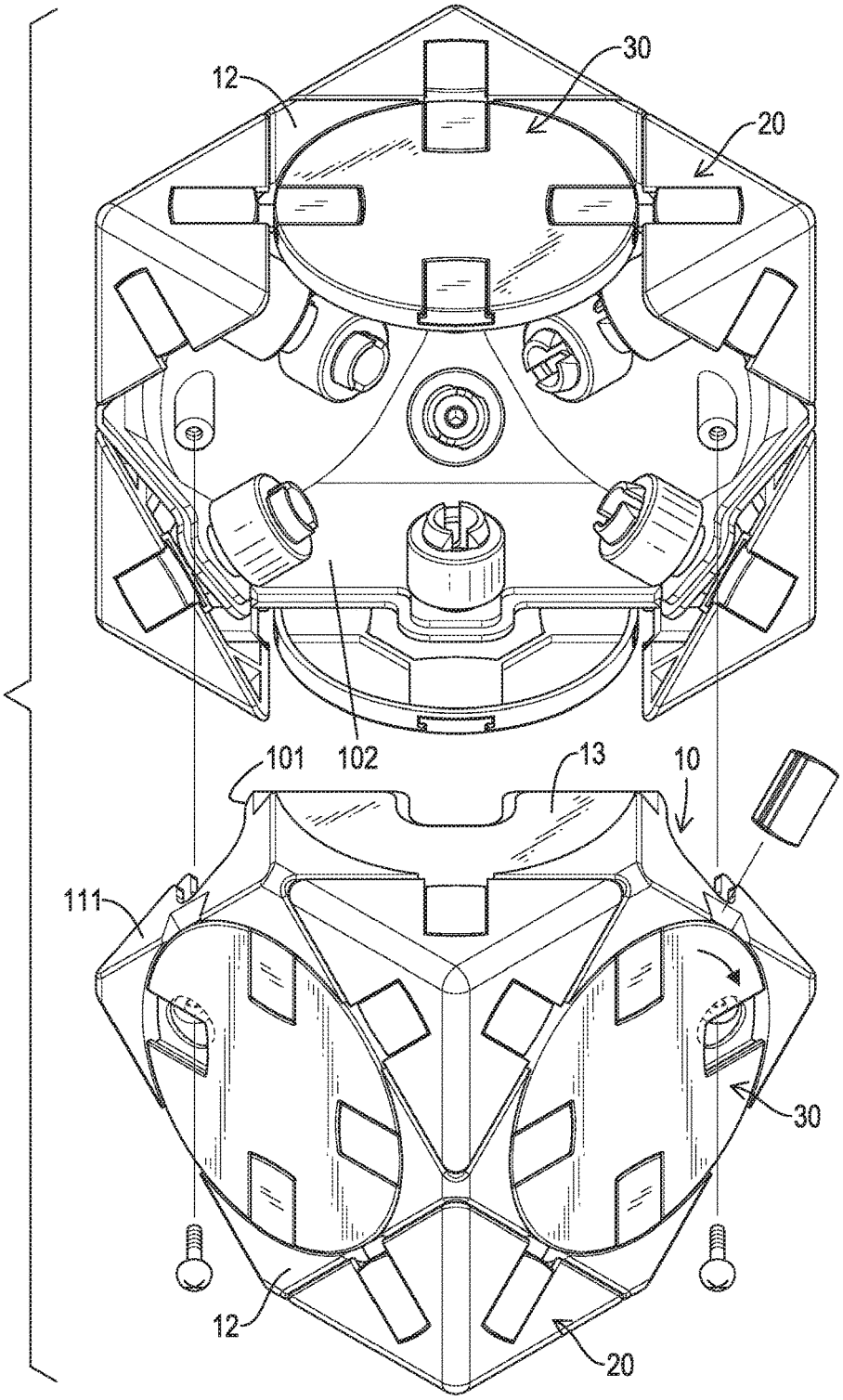
FIG. 2 is a partially exploded perspective view of the multi-axis rotational puzzle cube in FIG. 1.
Figure 5:
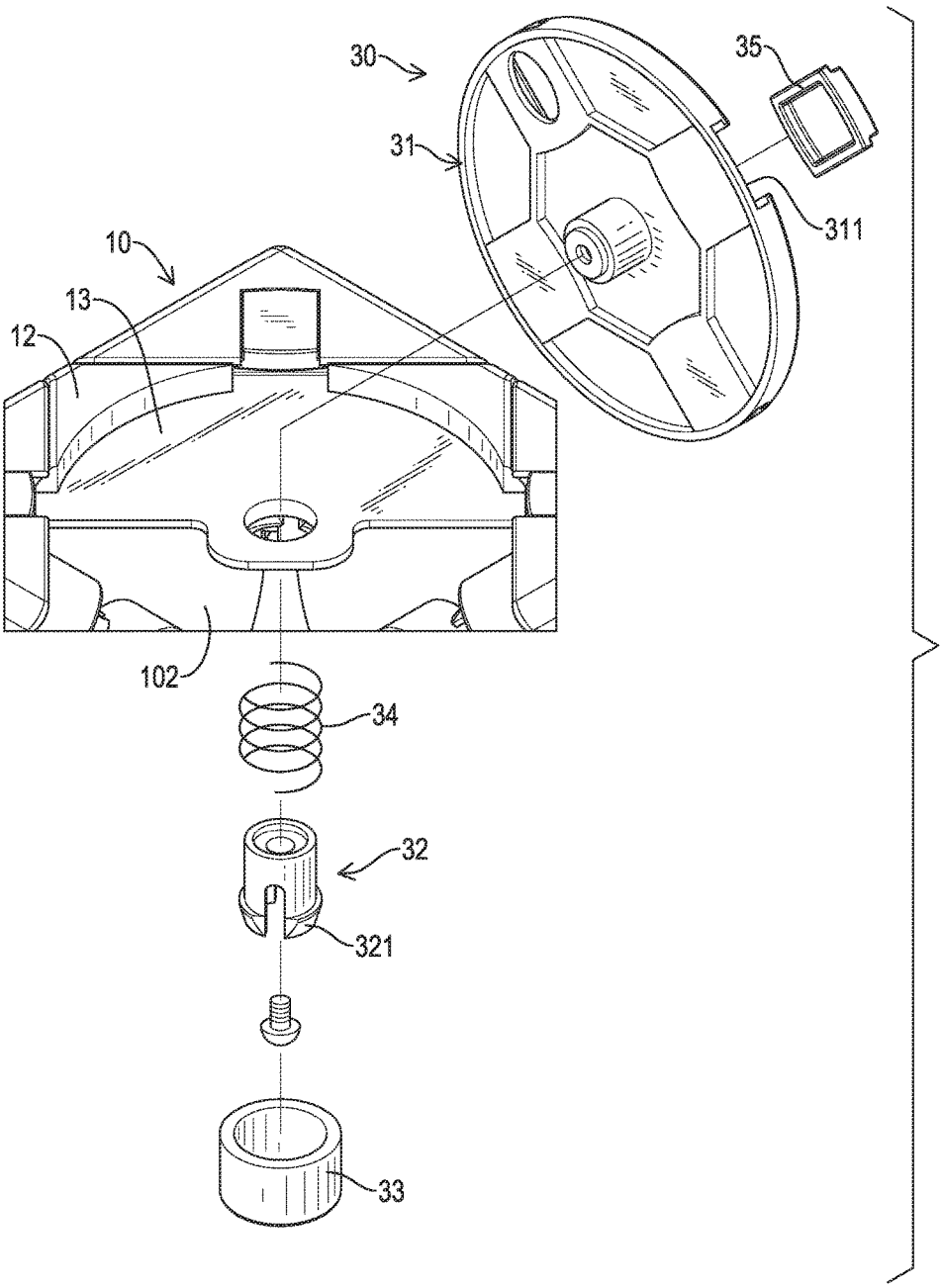
FIG. 5 is a partially exploded perspective view of a second operating assembly of the multi-axis rotational puzzle cube in FIG. 1.

With reference to FIGS. 1, 2, and 5, the core unit 10 is a hollow polyhedron and has a first shell 101, a second shell 102, multiple first assembling plates 11, multiple second assembling plates 12, and multiple fitting recesses 13. The first shell 101 and the second shell 102 are connected together to form the core unit 10. Each one of the multiple first assembling plates 11 has an external face. Each one of the multiple second assembling plates 12 has an exterior face. The multiple fitting recesses 13 are separately defined in the multiple exterior faces of the multiple second assembling plates 12. The multiple fitting recesses 13 are round recesses.

With reference to FIGS. 1 to 4, the multiple first operating assemblies 20 are rotatably and respectively assembled to the multiple first assembling plates 11 of the core unit 10. Each one of the multiple operating assemblies 20 is assembled to a cone sponding one of the multiple first assembling plates 11 and has a first operating unit 21, a snap rivet 22, a blocking tube 23, a compression spring 24, and multiple sliding plates 25. The first operating unit 21 has a polyhedral shell 211 and a guiding member 212. The polyhedral shell 211 is a hollow polyhedron and has multiple constructing plates 2111, an opening, a connecting shank 2112, and multiple notches 2113. The opening is surrounded by the multiple constructing plates 2111. The connecting shank 2112 extends from an interior of the polyhedral shell 211 and extends toward the opening of the polyhedral shell 211. The multiple notches 2113 are formed through the polyhedral shell 211 and communicate with the opening of the polyhedral shell 211.

With reference to FIGS. 1 to 4, the guiding member 212 of the first operating unit 21 is disposed inside the polyhedral shell 211 of the first operating unit 21. The guiding member 212 has a mounting tube 2121 and multiple troughs 2122. The mounting tube 2121 is mounted around the connecting shank 2112 of the polyhedral shell 211 of the operating unit 21 and has a peripheral face. The multiple troughs 2122 are connected to the peripheral face of the mounting tube 2121 and are disposed around the mounting tube 2121 at equi-angular intervals. The multiple troughs 2122 are respectively aligned with the multiple notches 2113 of the polyhedral shell 211 and respectively abut against the multiple constructing plates 2111 of the polyhedral shell 211.

With reference to FIGS. 1 to 4, the snap rivet 22 of each of the multiple first operating assemblies 20 is disposed within the core unit 10 and has two opposite ends and a hook portion 221. One of the two opposite ends of the snap rivet 22 is coaxially connected to the connecting shank 2112 of the polyhedral shell 211 of the first operating unit 21 of the first operating assembly 20. The hook portion 221 is disposed at the other one of the two opposite ends of the snap rivet 22.

With reference to FIGS. 1 to 4, the blocking tube 23 of each of the multiple operating assemblies 20 is disposed within the core unit 10 and is mounted around the snap rivet 22 of the first operating assembly 20. The blocking tube 23 is blocked by the hook portion 221 of the snap rivet 22 and is stuck with the snap rivet 22.

With reference to FIGS. 1 to 4, the compression spring 24 of each of the multiple operating assemblies 20 is disposed within the core unit 10 and is mounted around the snap rivet 22 of the corresponding one of the first operating assembly 20. The compression spring 24 has two opposite ends. One of the two opposite ends of the compression spring 24 abuts against the corresponding one of the multiple first assembling plates 11 of the core unit 10. The other one of the two opposite ends of the compression spring 24 abuts against the blocking tube 23 of the corresponding one of the first operating assemblies 20.

With reference to FIGS. 1 to 4, the multiple sliding plates 25 of each of the multiple first operating assemblies 20 are assembled to the first operating unit 21 of the corresponding one of the multiple first operating assemblies 20 and are respectively slidable relative to the multiple constructing plates 2111 of the polyhedral shell 211 of the first operating unit 21. The multiple sliding plates 25 are respectively assembled in the multiple troughs 2122 of the guiding member 212 of the operating unit 21 and are respectively clamped by the multiple troughs 2122 and the multiple constructing plates 2111. The multiple sliding plates 25 are able to slide respectively in the multiple troughs 2122.

With reference to FIGS. 1 to 4, the multiple second operating assemblies 30 are rotatably and separately assembled to the multiple second assembling plates 12 of the core unit 10. Each one of the multiple second operating assemblies 30 is assembled to a corresponding one of the multiple second assembling plates 12 and has a second operating unit 31, a snap rivet 32, a blocking tube 33, a compression spring 34, and multiple sliding plates 35. The second operating unit 31 is a round plate and has an edge and multiple guiding recesses 311 disposed at the edge of the second operating unit 31 at equi-angular intervals. The multiple second operating units 31 of the multiple second operating assemblies 30 are respectively assembled in the multiple fitting recesses 13. The snap rivet 32 of each of the multiple second operating assemblies 30 is disposed within the core unit 10 and has two opposite ends and a hook portion 321. One of the two opposite ends of the snap rivet 32 is connected to the second operating unit 31 of the corresponding one of the multiple second operating assemblies 30. The hook portion 321 is disposed at the other one of the two opposite ends of the snap rivet 32. The blocking tube 33 is disposed within the core unit 10 and is mounted around the snap rivet 32 of the corresponding one of the multiple second operating assemblies 30. The blocking tube 33 is blocked by the hook portion 321 of the snap rivet 32 and is stuck with the snap rivet 32. The compression spring 34 is disposed within the core unit 10, is mounted around the snap rivet 32, and has two opposite ends. One of the two opposite ends of the compression spring 34 abuts against the corresponding one of the multiple second assembling plates 12 of the core unit 10. The other one of the two opposite ends of the compression spring 34 abuts against the blocking tube 33. The multiple sliding plates 35 are respectively assembled in the multiple guiding recesses 311. The multiple sliding plates 35 are able to slide respectively in the multiple guiding recesses 311 and able to slide relative to the second operating unit 31.

Figure 3:
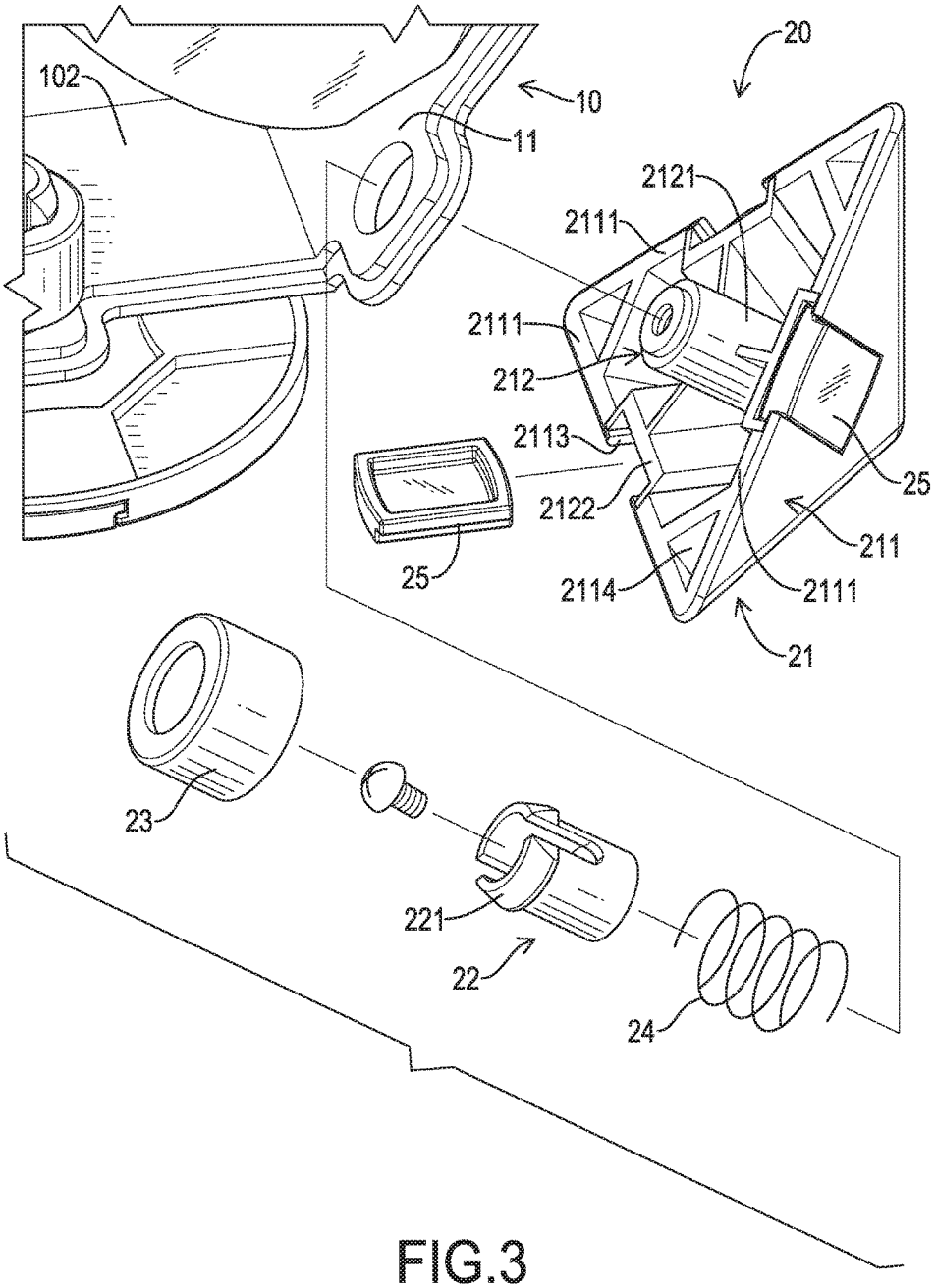
FIG. 3 is a partially exploded perspective view of a first operating assembly of the multi-axis rotational puzzle cube in FIG. 1.
Figure 4:
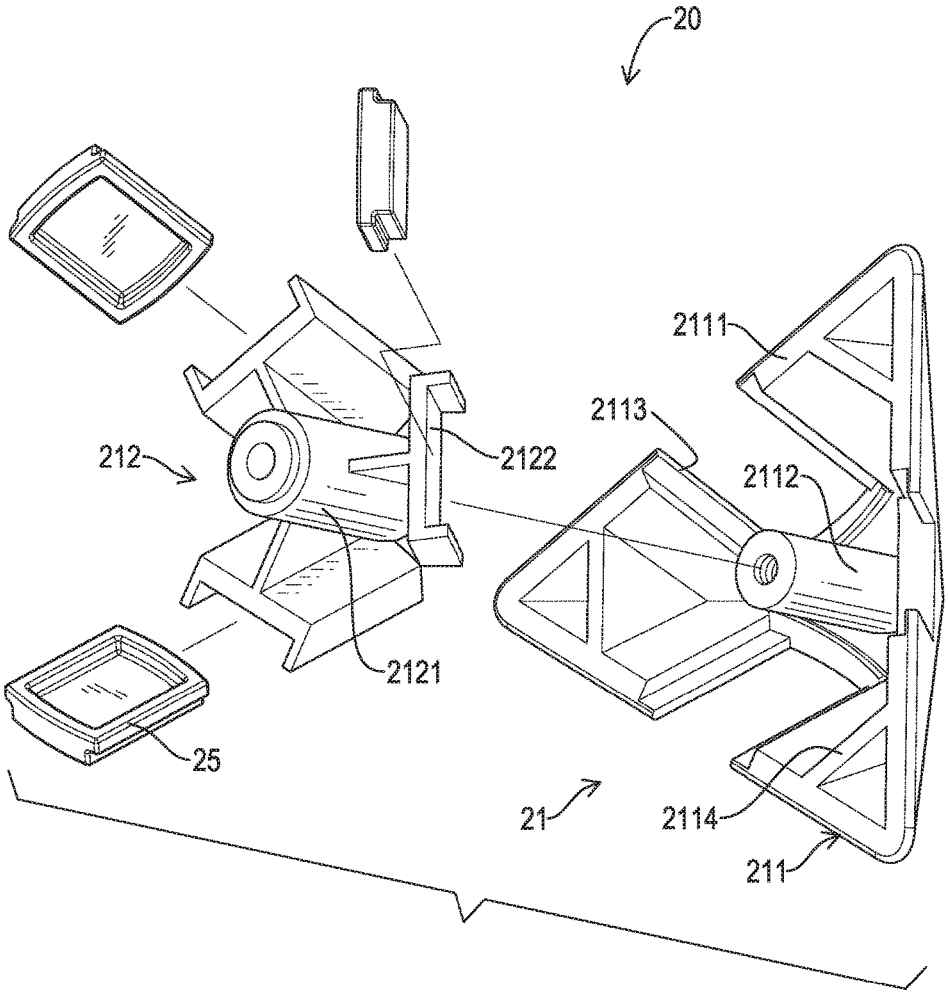
FIG. 4 is another partially exploded perspective view of the first operating assembly of the multi-axis rotational puzzle cube in FIG. 2.

With reference to FIGS. 1 to 3, since each one of the first operating assemblies 20 has a compression spring 24 abutting against the core unit 10 and the blocking tube 23 of the corresponding one of the multiple first operating assemblies 20 simultaneously, the first operating unit 21 is able to be slightly moved apart from the core unit 10 along a direction in which the snap rivet 22 is disposed.

With reference to FIGS. 1 and 5, since each one of the second operating assemblies 30 has a compression spring 34 abutting against the core unit 10 and the blocking tubes 33 simultaneously, the second operating unit 31 is able to be slightly moved apart from the core unit 10 along a direction in which the snap rivet 32 is disposed.

Once the first operating unit 21, the multiple sliding plates 25 assembled to the first operating unit 21, the second operating unit 31, and the multiple sliding plates 35 are assembled to the second operating unit 31 of one of the multiple first operating assemblies 20 and one of the multiple second operating assemblies 30 are interfered with one another, the first operating unit 21 and the second operating unit 31 are rotated. The first operating unit 21 and the second operating unit 31 are able to be slightly moved apart from the core unit 10 to avoid the interference and to make the first operating unit 21 and the second operating unit 31 rotated smoothly. With the first operating unit 21 and the second operating unit 31 that are able to be slightly moved apart from the core unit 10, the multi-axis rotational puzzle cube in accordance with the present invention may be operated smoothly and the user experience of playing the multi-axis rotational puzzle cube is promoted.

With reference to FIGS. 1 and 2, the core unit 10 composed by the first shell 101 and the second shell 102 makes the snap rivets 22, 32, the blocking tubes 23, 33, and the compression springs 24, 34 of each one of the multiple first operating assemblies 20 and each one of the multiple second operating assemblies 30 easily to be assembled inside the core unit 10.

In the first embodiment of the present invention, the multi-axis rotational puzzle cube is a hexahedron. The core unit 10 is a tetradecahedron. The core unit 10 has eight first assembling plates 11 and six said second assembling plates 12. The multiple fitting recesses 13 are six fitting recesses 13 respectively defined in six exterior faces of the six second assembling plates 12. The multiple first operating assemblies 20 include eight said first operating assemblies 20. The eight first operating assemblies 20 are respectively assembled to the eight first assembling plates 11. The multiple first operating units 21 of the eight first operating assemblies 20 are eight said first operating units 21. The multiple second operating assemblies 30 include six said second operating assemblies 30. The six second operating assemblies 30 are respectively assembled to the six second assembling plates 12.

Each one of the eight polyhedral shells 211 of the eight first operating units 21 is a hollow tetrahedron. The multiple constructing plates 2111 of the polyhedral shell 211 include three said constructing plates 2111. The three constructing plates 2111 join together to form a vertex of the polyhedral shell 211 that is a hollow tetrahedron. The connecting shank 2112 extends from the vertex toward the opening of the polyhedral shell 211 of the first operating unit 21. The opening of the polyhedral shell 211 is surrounded by three edges of the three constructing plates 2111. The opening of the polyhedral shell 211 has a triangular outline and three corners. The multiple notches 2113 include three said notches 2113. The three notches 2113 are respectively disposed at the three edges of the three constructing plates 2111 and communicating with the opening of the polyhedral shell 211.

Figure 6:
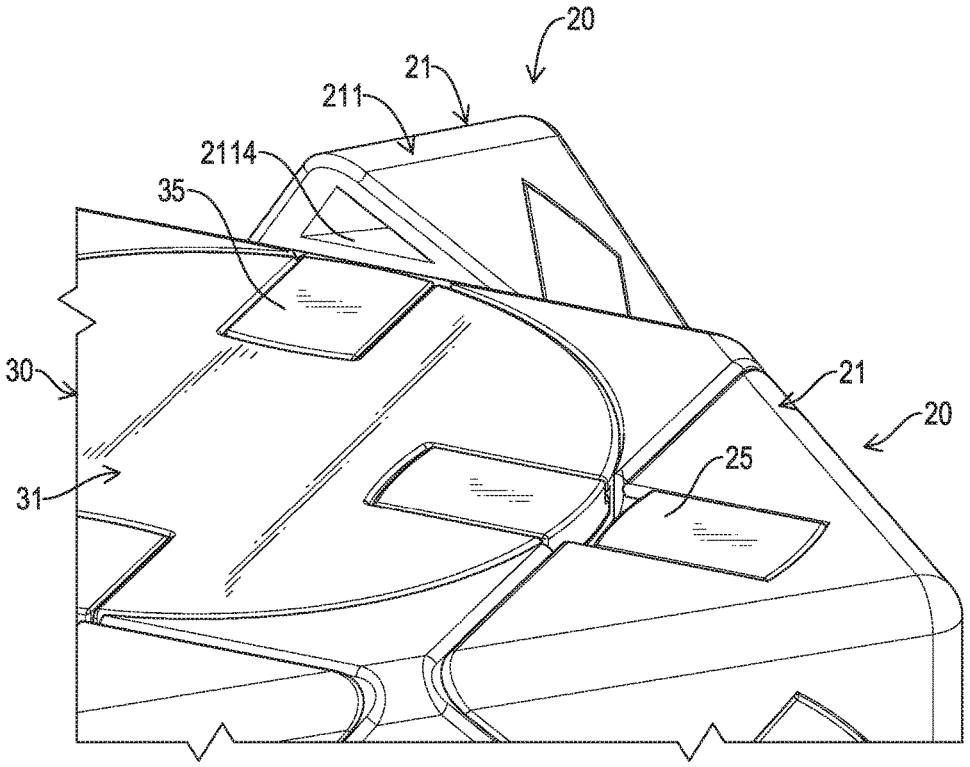
FIG. 6 is a schematic perspective view of the multi-axis rotational puzzle cube in FIG. 1.

With reference to FIG. 3, in the first embodiment of the present invention, the polyhedral shell 211 of each one of the eight first operating units 21 of the eight first operating assemblies 20 further has three blocking ribs 2114. The three blocking ribs 2114 are disposed within the polyhedral shell 211 and are respectively disposed at the three corners of the opening of the polyhedral shell 211. With reference to FIG. 6, when one of the eight first operating assemblies 20 is rotated, one of the three blocking ribs 2114 can block one of the multiple sliding plates 35 that slides relative to one of the six second operating units 31 that is disposed adjacent said one of the first operating assemblies 20.

Figure 7:
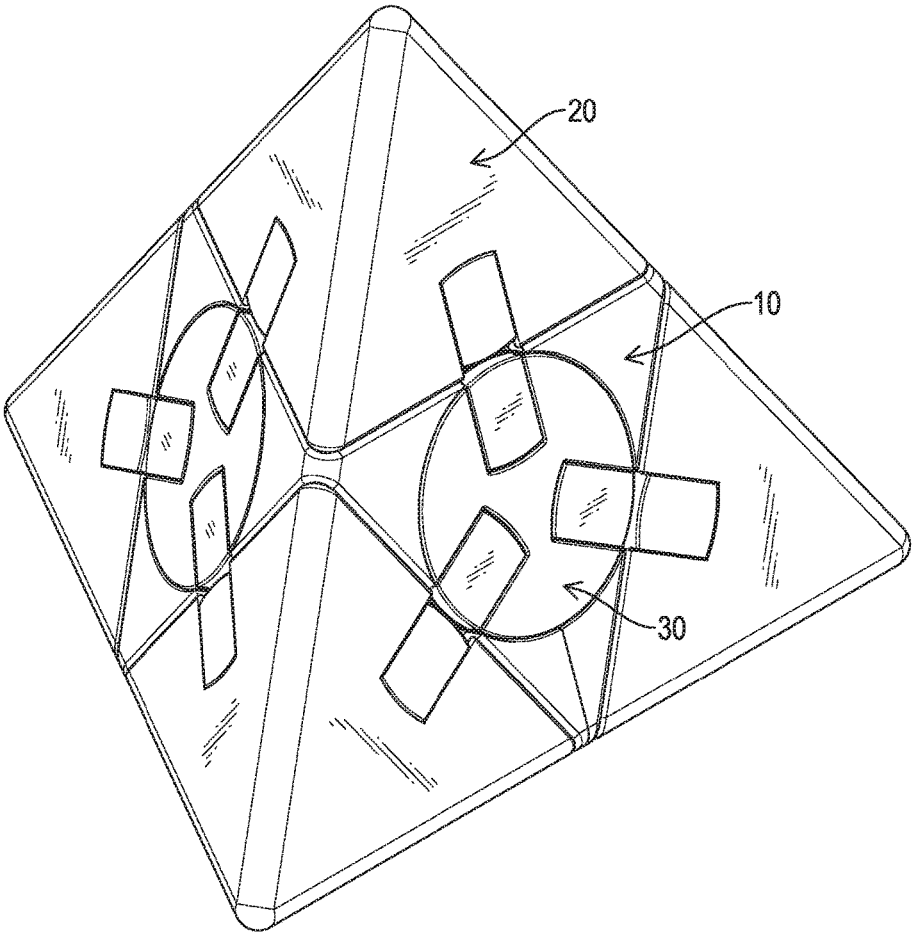
FIG. 7 is a perspective view of a second embodiment of a multi-axis rotational puzzle cube in accordance with the present invention.
Figure 8:
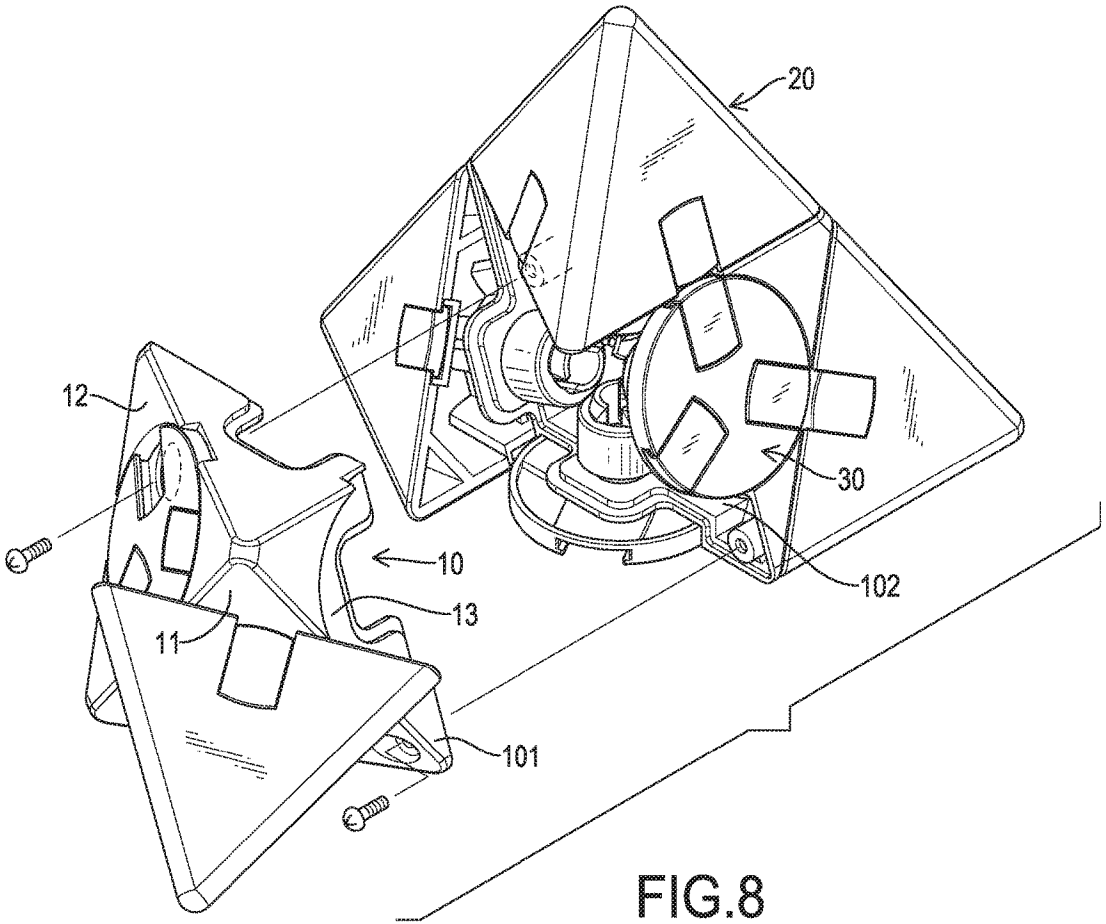
FIG. 8 is a partially exploded perspective view of the multi-axis rotational puzzle cube in FIG. 7.
Figure 9:
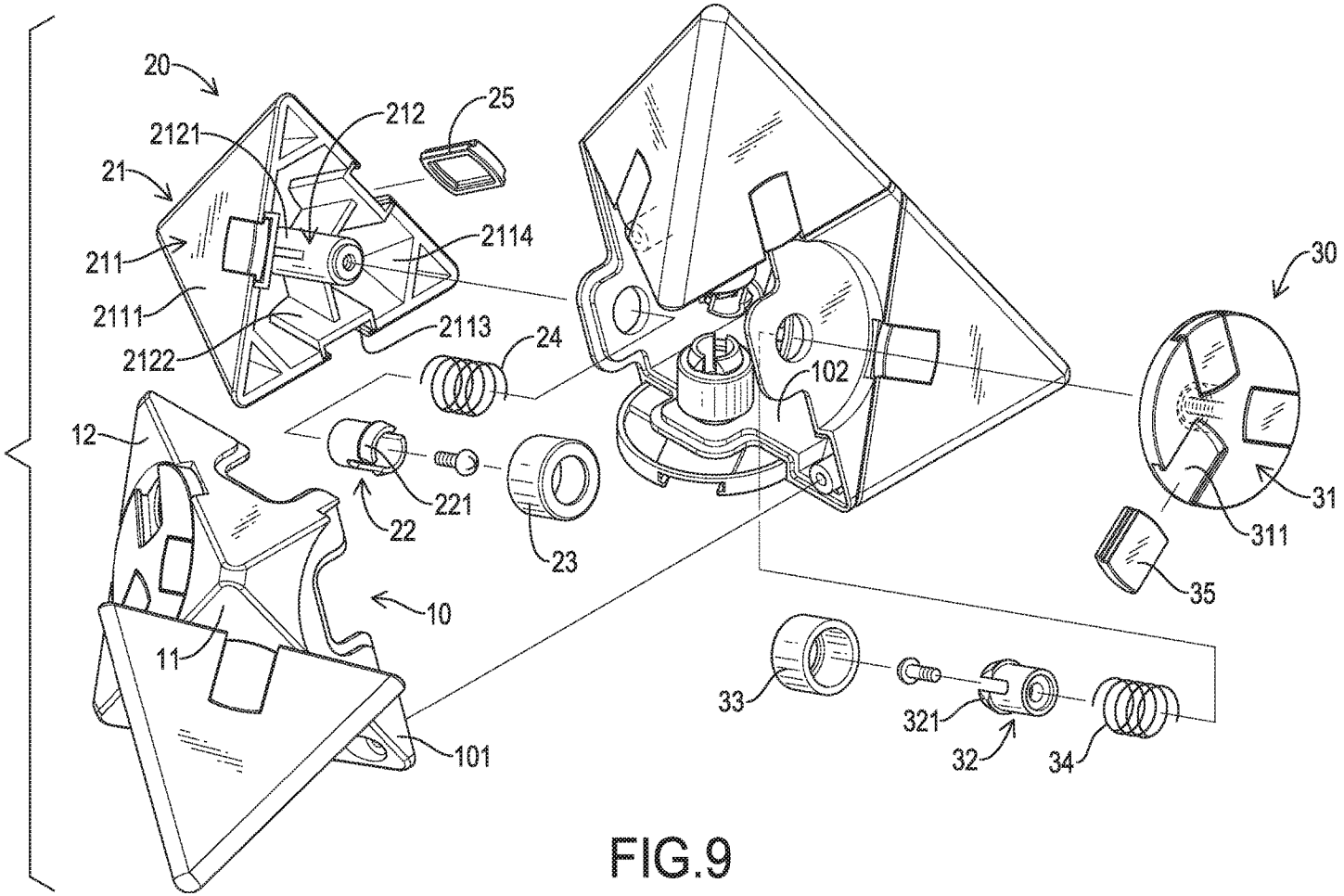
FIG. 9 is another partially exploded perspective view of the multi-axis rotational puzzle cube in FIG. 7.
Figure 10:
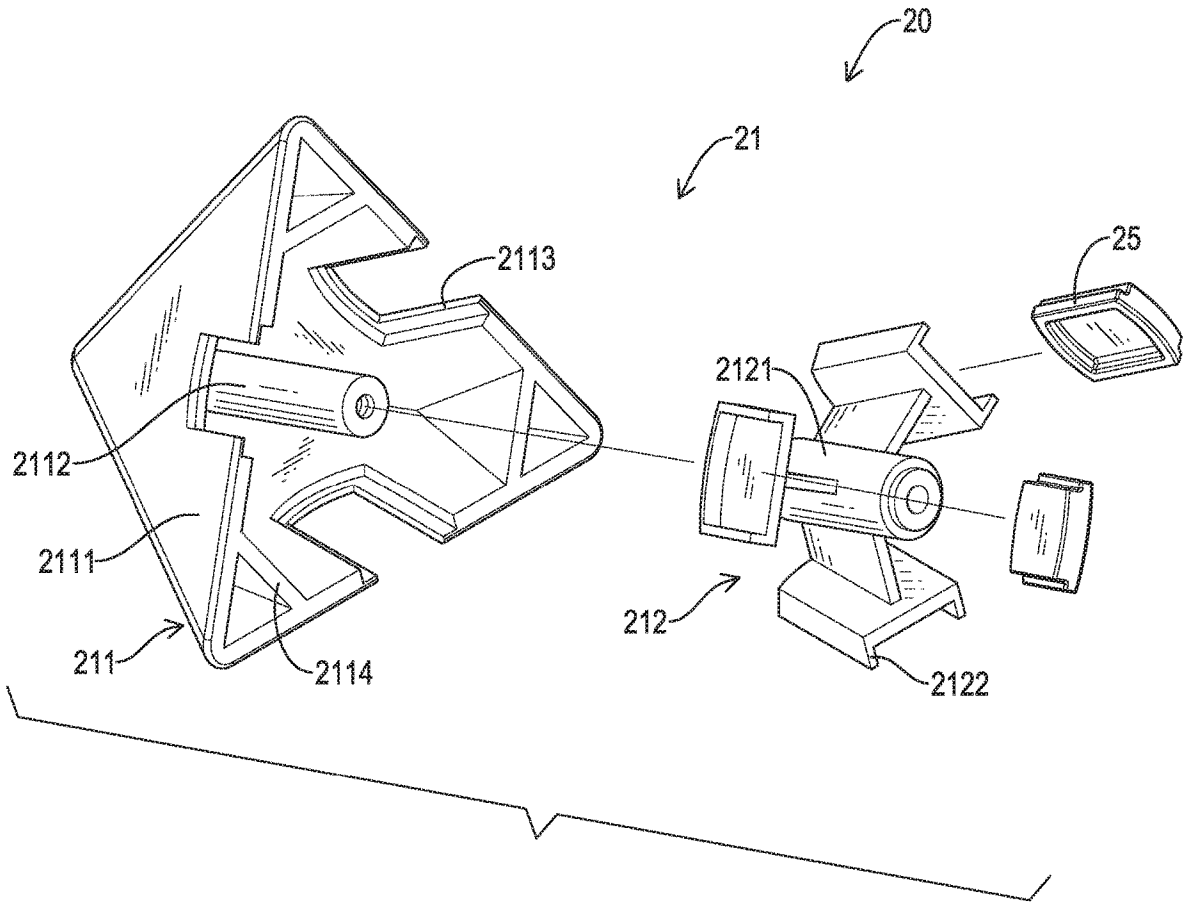
FIG. 10 is a partially exploded perspective view of a first operating assembly of the multi-axis rotational puzzle cube in FIG. 9.

With reference to FIGS. 6 to 8, a second embodiment of the multi-axis rotational puzzle cube in accordance with the present invention is substantially same as the first embodiment. In the second embodiment, the multi-axis rotational puzzle cube also has the core unit 10, the multiple first operating assemblies 20, and the multiple second operating assemblies 30. In the second embodiment of the present invention, the multi-axis rotational puzzle cube is a tetrahedron. The core unit 10 is an octahedron and has four first assembling plates 11 and four second assembling plates 12. The multiple first operating assemblies 20 include four said first operating assemblies 20. The multiple second operating assemblies 30 include four said second operating assemblies 30.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A rotational puzzle cube comprising:

a core unit being a hollow polyhedron and having a first shell; and a second shell;

the first shell and the second shell being connected together to form the core unit;

multiple first assembling plates each having an external face; and multiple second assembling plates each having an exterior face;

multiple first operating assemblies rotatably and respectively assembled to the multiple first assembling plates of the core unit, and each one of the multiple first operating assemblies having a first operating unit connected to the external face of a corresponding one of the multiple first assembling plates;

a snap rivet disposed within the core unit and connected to the first operating unit;

a blocking tube disposed within the core unit, and mounted around and stuck with the snap rivet of the first operating assembly;

a compression spring disposed within the core unit, mounted around the snap rivet of the first operating assembly, and having two opposite ends;

one of the two opposite ends of the compression spring abutting against the core unit; and another one of the two opposite ends of the compression spring abutting against the blocking tube; and multiple sliding plates assembled to the first operating unit and being slidable relative to the first operating unit; and multiple second operating assemblies rotatably and respectively assembled to the multiple second assembling plates of the core unit, and each one of the multiple second operating assemblies having a second operating unit being a plate and connected to the exterior face of a corresponding one of the multiple second assembling plates;

a snap rivet disposed within the core unit and connected to the second operating unit;

a blocking tube disposed within the core unit, and mounted around and stuck with the snap rivet of the second operating assembly; and multiple sliding plates assembled to the second operating unit and being slidable relative to the second operating unit;

each one of the multiple first operating units of the multiple first operating assemblies having a polyhedral shell being a hollow polyhedron and having multiple constructing plates;

an opening surrounded by the multiple constructing plates;

a connecting shank extending from an interior of the polyhedral shell and extending toward the opening of the polyhedral shell; and multiple notches formed through the polyhedral shell and communicating with the opening; and a guiding member disposed inside the polyhedral shell and having multiple troughs respectively aligned with the multiple notches and respectively abutting against the multiple constructing plates; wherein the guiding member has a mounting tube mounted around the connecting shank;

the multiple troughs of the guiding member are connected to a peripheral face of the mounting tube and are disposed around the mounting tube at equiangular intervals; and the multiple sliding plates of each one of the first operating assemblies are respectively assembled in the multiple troughs of the guiding member and are respectively clamped by the multiple troughs and the multiple constructing plates of the polyhedral shell.

2. The rotational puzzle cube as claimed in claim 1, wherein the multiple snap rivets of the multiple first operating assemblies are respectively connected to the multiple connecting shanks of multiple said polyhedral shells of the multiple first operating units coaxially.

3. The rotational puzzle cube as claimed in claim 2, wherein the rotational puzzle cube is a hexahedron;

the core unit is a tetradecahedron and has eight said first assembling plates and six said second assembling plates;

the multiple first operating assemblies are eight said first operating assemblies respectively assembled to the eight first assembling plates;

each one of eight polyhedral shells of the eight first operating units is a hollow tetrahedron and has three said constructing plates; and the multiple second operating assemblies are six said second operating assemblies respectively assembled to the six second assembling plates.

4. The rotational puzzle cube as claimed in claim 3, wherein each one of the eight polyhedral shells further has three blocking ribs;

the opening of each polyhedral shell has a triangular outline and three corners; and the three blocking ribs are disposed within the polyhedral shell and respectively disposed at the three corners of the opening of the polyhedral shell.

5. The rotational puzzle cube as claimed in claim 2, wherein the rotational puzzle cube is a tetrahedron;

the core unit is an octahedron and has four said first assembling plates and four said second assembling plates;

the multiple first operating assemblies are four said first operating assemblies respectively assembled to the four first assembling plates;

each one of four polyhedral shells of the four first operating units is a hollow tetrahedron and has three said constructing plates; and the multiple second operating assemblies are four said second operating assemblies separately assembled to the four second assembling plates.

6. The rotational puzzle cube as claimed in claim 5, wherein each one of the four polyhedral shells further has three blocking ribs;

the opening of each polyhedral shell has a triangular outline and three corners; and the three blocking ribs are disposed within the polyhedral shell and respectively disposed at the three corners of the opening of the polyhedral shell.

7. A rotational puzzle cube comprising:

a core unit being a hollow polyhedron and having multiple first assembling plates each having an external face; and multiple second assembling plates each having an exterior face;

multiple first operating assemblies rotatably and respectively assembled to the multiple first assembling plates of the core unit, and each one of the multiple first operating assemblies having a first operating unit connected to the external face of a corresponding one of the multiple first assembling plates;

a snap rivet disposed within the core unit and connected to the first operating unit;

a blocking tube disposed within the core unit, and mounted around and stuck with the snap rivet of the first operating assembly;

a compression spring disposed within the core unit, mounted around the snap rivet of the first operating assembly, and having two opposite ends;

one of the two opposite ends of the compression spring abutting against the core unit; and another one of the two opposite ends of the compression spring abutting against the blocking tube; and multiple sliding plates assembled to the first operating unit and being slidable relative to the first operating unit; and multiple second operating assemblies rotatably and respectively assembled to the multiple second assembling plates of the core unit, and each one of the multiple second operating assemblies having a second operating unit being a plate and connected to the exterior face of a corresponding one of the multiple second assembling plates;

a snap rivet disposed within the core unit and connected to the second operating unit;

a blocking tube disposed within the core unit, and mounted around and stuck with the snap rivet of the second operating assembly; and multiple sliding plates assembled to the second operating unit and being slidable relative to the second operating unit;

wherein each one of the multiple first operating units of the first multiple operating assemblies has a polyhedral shell being a hollow polyhedron and having multiple constructing plates;

an opening surrounded by the multiple constructing plates; and multiple notches formed through the polyhedral shell and communicating with the opening; and a guiding member disposed inside the polyhedral shell and having multiple troughs respectively aligned with the multiple notches and respectively abutting against the multiple constructing plates; and the multiple sliding plates of each of the first operating assemblies are respectively assembled in the multiple troughs of the guiding member of the corresponding one of the multiple first operating units and are respectively clamped by the multiple troughs and the multiple constructing plates of the polyhedral shell; and wherein the polyhedral shell has a connecting shank extending from an interior of the polyhedral shell and extending toward the opening of the polyhedral shell;

the guiding member has a mounting tube mounted around the connecting shank; and the multiple troughs of the guiding member are connected to a peripheral face of the mounting tube and are disposed around the mounting tube at equi-angular intervals.

8. The rotational puzzle cube as claimed in claim 7, wherein the multiple snap rivets of the multiple first operating assemblies are respectively connected to the multiple connecting shanks of multiple said polyhedral shells of the multiple first operating units coaxially.

9. The rotational puzzle cube as claimed in claim 8, wherein the rotational puzzle cube is a hexahedron;

the core unit is a tetradecahedron and has eight said first assembling plates and six said second assembling plates;

the multiple first operating assemblies are eight said first operating assemblies respectively assembled to the eight first assembling plates;

each one of eight polyhedral shells of the eight first operating units is a hollow tetrahedron and has three said constructing plates; and the multiple second operating assemblies are six said second operating assemblies respectively assembled to the six second assembling plates.

10. The rotational puzzle cube as claimed in claim 9, wherein each one of the eight polyhedral shells further has three blocking ribs;

the opening of each polyhedral shell has a triangular outline and three corners; and the three blocking ribs are disposed within the polyhedral shell and respectively disposed at the three corners of the opening of the polyhedral shell.

11. The rotational puzzle cube as claimed in claim 8, wherein the rotational puzzle cube is a tetrahedron;

the core unit is an octahedron and has four said first assembling plates and four said second assembling plates;

the multiple first operating assemblies are four said first operating assemblies respectively assembled to the four first assembling plates;

each one of four polyhedral shells of the four first operating units is a hollow tetrahedron and has three said constructing plates; and the multiple second operating assemblies are four said second operating assemblies respectively assembled to the four second assembling plates.

12. The rotational puzzle cube as claimed in claim 11, wherein each one of the four polyhedral shells further has three blocking ribs;

the opening of each polyhedral shell has a triangular outline and three corners; and the three blocking ribs are disposed within the polyhedral shell and respectively disposed at the three corners of the opening of the polyhedral shell.

* * * * *